US011067094B2

(12) United States Patent
Iwakiri et al.

(10) Patent No.: US 11,067,094 B2
(45) Date of Patent: Jul. 20, 2021

(54) COMPRESSOR SCROLL AND CENTRIFUGAL COMPRESSOR

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Isao Tomita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 79 days.

(21) Appl. No.: 16/079,852

(22) PCT Filed: Mar. 30, 2016

(86) PCT No.: PCT/JP2016/060477
§ 371 (c)(1),
(2) Date: Aug. 24, 2018

(87) PCT Pub. No.: WO2017/168650
PCT Pub. Date: Oct. 5, 2017

(65) Prior Publication Data

US 2019/0055959 A1 Feb. 21, 2019

(51) Int. Cl.
*F04D 29/42* (2006.01)
*F04D 29/44* (2006.01)
*F04D 17/10* (2006.01)

(52) U.S. Cl.
CPC ..... *F04D 29/4206* (2013.01); *F04D 17/10* (2013.01); *F04D 29/441* (2013.01); *F05D 2250/52* (2013.01)

(58) Field of Classification Search
CPC .. F04D 29/4206; F04D 29/441; F04D 29/422; F04D 17/10; F04D 42/42; F02B 33/40; F05D 2250/52
See application file for complete search history.

(56) References Cited

U.S. PATENT DOCUMENTS 3,824,028 A * 7/1974 Zenkner ..... F04D 29/4213 415/58.6
6,146,092 A * 11/2000 Botros ..... B60H 1/00471 415/119

(Continued)

FOREIGN PATENT DOCUMENTS

EP 3 299 635 A1 3/2018
GB 2 057 567 A 4/1981

(Continued)

OTHER PUBLICATIONS

International Search Report dated Jul. 5, 2016 in counterpart PCT Application No. PCT/JP2016/060477 with an English Translation.

(Continued)

*Primary Examiner* — Igor Kershteyn
*Assistant Examiner* — Joshua R Beebe
(74) *Attorney, Agent, or Firm* — Birch, Stewart, Kolasch & Birch, LLP

(57) ABSTRACT

A compressor scroll (1A) is provided with: a scroll-flow-path formation part (8A) that forms a scroll flow path; and an outlet-flow-path formation part (9) that is connected to a winding-end section (11) of a scroll flow path (8*a*) and that forms an outlet flow path (9*a*) extending in a direction tangential to a circle around an axis (O), wherein, at least at the winding-end section (11) in an area where a winding-start section (10) intersects with the winding-end section (11), the scroll-flow-path formation part (8A) is provided with a bulging part (15A) that bulges the scroll flow path in the radial direction toward the side where the winding-start section (10) is present.

20 Claims, 9 Drawing Sheets

(56) References Cited

U.S. PATENT DOCUMENTS

| | | | | |
|---|---|---|---|---|
| 9,404,509 | B2 * | 8/2016 | Isogai | F01D 9/026 |
| 10,138,898 | B2 * | 11/2018 | Bessho | F04D 29/441 |
| 2012/0211205 | A1 * | 8/2012 | Eguchi | F04D 17/16 165/121 |
| 2013/0266432 | A1 | 10/2013 | Iwakiri et al. | |
| 2013/0343885 | A1 * | 12/2013 | Iwakiri | F04D 29/667 415/204 |
| 2014/0086726 | A1 * | 3/2014 | Isogai | F01D 9/026 415/73 |
| 2016/0138608 | A1 * | 5/2016 | Bessho | F04D 29/441 415/204 |
| 2017/0008368 | A1 * | 1/2017 | Tanaka | F04D 29/441 |
| 2017/0151608 | A1 * | 6/2017 | Isogai | B22D 17/20 |
| 2018/0291922 | A1 | 10/2018 | Iwakiri et al. | |
| 2018/0355886 | A1 * | 12/2018 | Fujiwara | F04D 29/422 |

FOREIGN PATENT DOCUMENTS

| | | | | |
|---|---|---|---|---|
| JP | 4492045 | B2 | 6/2010 | |
| JP | 2012184758 | A * | 9/2012 | F04D 29/464 |
| JP | 5479316 | B2 | 4/2014 | |
| WO | WO 2017/072899 | A1 | 5/2017 | |

OTHER PUBLICATIONS

Written Opinion dated Jul. 5, 2016 in counterpart PCT Application No. PCT/JP2016/060477 with an English Translation.

* cited by examiner

COMPRESSOR SCROLL AND CENTRIFUGAL COMPRESSOR

TECHNICAL FIELD

The present invention relates to a compressor scroll and a centrifugal compressor.

BACKGROUND ART

A centrifugal compressor used as a compressor of a turbocharger imparts kinetic energy to a fluid by the rotation of an impeller, discharges the fluid in a radially outward direction thereof, and applies centrifugal force to the fluid to raise the pressure of the fluid.

This type of the centrifugal compressor has, in general, a diffuser and a scroll radially outside the impeller. The diffuser decreases the speed of a fluid. The scroll is formed to have a spiral shape and leads a fluid, which is discharged from the diffuser, to an outlet flow path.

In order to meet a need for a high pressure ratio and a high efficiency in a wide operating range, a technique of making a cross sectional shape of a flow path connecting portion where a spiral starting part and a spiral ending part of the scroll intersect each other a flat shape and gradually returning the cross sectional shape of the scroll from the spiral starting part toward the spiral ending part to a circular shape is disclosed in PTL 1.

In order to mainly improve efficiency at a low flow rate operation point, a technique of making a cross sectional shape of the spiral starting part of the scroll a shape similar to a triangular shape is disclosed in PTL 2.

CITATION LIST

Patent Literature

[PTL 1] Japanese Patent No. 5479316
[PTL 2] Japanese Patent No. 4492045

SUMMARY OF INVENTION

Technical Problem

It is desirable for a centrifugal compressor to realize a high pressure ratio and to improve efficiency over the entire area ranging from a high flow rate operation point to a low flow rate operation point. However, the centrifugal compressors of PTLs 1 and 2 can improve efficiency at a low flow rate operation point, but do not give consideration to efficiency improvement at a high flow rate operation point.

At a high flow rate operation point, a diffuser outlet flow of a fluid has a speed component of the impeller in a radial direction larger than a speed component of the impeller in a circumferential direction. For this reason, the diffuser outlet flow intersects a ridgeline formed in a portion where the spiral starting part and the spiral ending part of the scroll are connected to each other at an angle close to a right angle. As described above, a loss occurred due to peeling at the ridgeline by the fluid becomes large by the diffuser outlet flow intersecting the ridgeline.

An object of the invention is to provide a compressor scroll and a centrifugal compressor, which can improve efficiency at a high flow rate operation point.

Solution to Problem

According to a first aspect of the invention, there is provided a compressor scroll including a scroll flow path forming portion that forms a scroll flow path extending in a circumferential direction about an axis, having a spiral starting portion and a spiral ending portion intersecting and communicating with each other, and allowing a fluid to flow therein from a diffuser outlet formed on a first side of an axis direction and in a radially inward direction about the axis. The compressor scroll further includes an outlet flow path forming portion that forms an outlet flow path communicating with the spiral ending portion of the scroll flow path and extending in a tangential direction of a circle about the axis. The scroll flow path forming portion has an expanded portion, which causes the scroll flow path to expand toward the spiral starting portion in the radial direction, at least in the spiral ending portion in a portion where the spiral starting portion and the spiral ending portion intersect each other.

The practical curvature radius of the spiral ending portion intersecting the spiral starting portion can be made large by including such an expanded portion. For this reason, it is possible to suppress a protrusion, which is a ridgeline formed by the spiral starting portion and the spiral ending portion intersecting each other, to be low and to suppress the occurrence of peeling. Therefore, it is possible to reduce a loss at a high flow rate operation point to improve efficiency.

According to a second aspect of the invention, in the compressor scroll of the first aspect, an expansion changing portion in which expansion of the expanded portion gradually reduces as becoming closer to at least one of an upstream side or a downstream side of the scroll flow path from the expanded portion may be further included.

By configuring in this manner, it is possible to suppress that a fluid flowing in the scroll flow path toward at least one of the expanded portion or an upstream side and a downstream side of the expanded portion peels an inner circumferential surface of the scroll flow path forming portion.

According to a third aspect of the invention, in the compressor scroll, the expanded portion of the first or second aspect may further have a curved surface of which a cross section has an elliptical shape having a major axis extending toward a side close to the axis.

Without increasing the dimension in the axis direction, the scroll flow path can be expanded by the expanded portion including the curved surface of which the cross section has an elliptical shape as described above.

According to a fourth aspect of the invention, in the compressor scroll, in the expanded portion of any one aspect of the first to third aspects, a vertex that is most expanded to a side close to the axis in a cross section orthogonal to the scroll flow path may be disposed to a second side opposite to the first side in a direction where the axis extends from a middle position of a maximum width dimension of the spiral ending portion in the direction where the axis extends.

At a high flow rate operation point described above, the flow rate of a fluid increases. For this reason, when the flow rate of this fluid is set as a reference, it seems that a flow path cross sectional area of the scroll flow path has relatively decreased. Accordingly, in particular, a rotation component of the fluid in the spiral ending portion increases in some cases. Due to the increase in the rotation component, a diffuser outlet flow and a rotating flow heading for the outlet interfere each other from the spiral ending portion, and peeling occurs. Thus, there is a possibility that a loss increases. However, by disposing the vertex on the second side of the middle position as described above, the curvature radius of the second side can be made larger than that of the first side with the position of the vertex as a boundary. That is, the curvature radius of the inner circumferential surface of the expanded portion can be drastically increased on the second side. For this reason, due to the increase in the curvature radius, the rotating flow collides with the inner circumferential surface almost perpendicularly, and the rotation component can be reduced. As a result, it is possible to suppress peeling caused by collision (interference) between a rotation component and a diffuser outlet flow.

According to a fifth aspect of the invention, in the compressor scroll, the expanded portion of the fourth aspect may have a linear portion, which has a linearly formed cross sectional shape orthogonal to the scroll flow path, in at least a part of an inner circumferential surface thereof.

By configuring in this manner, a rotating flow of the scroll flow path can be caused to collide with the linear portion. For this reason, the rotating flow of the scroll flow path is reduced, and a loss caused by interference of the rotating flow with respect to the diffuser outlet flow can be suppressed.

According to a sixth aspect of the invention, in the compressor scroll, the expanded portion of the fifth aspect may have the linear portion which is formed from the vertex most expanded to the side close to the axis toward the first side of the axis direction.

By configuring in this manner, a rotation component of a fluid in the scroll flow path can be reduced further than a case where the curved surface is formed from the vertex toward the first side.

According to a seventh aspect of the invention, in the compressor scroll of the fourth aspect, a diffuser connecting portion connected to the diffuser may be further included. The linear portion may be formed to gradually move from the second side to the first side of the axis direction as becoming closer to a downstream side of the scroll flow path from an upstream side.

By configuring in this manner, the linear portion can be disposed according to the position of the rotating flow. For this reason, the rotating flow can be efficiently reduced from the upstream side to the downstream side of the scroll flow path.

According to an eighth aspect of the invention, in the compressor scroll, the spiral starting portion of any one aspect of the first to the seventh aspects may be formed such that a flow path width in a direction where the axis extends gradually increases from a first vertex disposed on the outermost side of a radial direction about the axis toward a second vertex disposed to be closest to the second side in the direction where the axis extends, and the second vertex may be disposed radially inside a midpoint of a maximum flow path width in the radial direction.

By configuring in this manner, a recirculating flow from the spiral ending portion to the spiral starting portion can be suppressed at a low flow rate operation point. For this reason, a loss at a high flow rate operation point can be reduced, and a loss at the low flow rate operation point can be reduced. Therefore, efficiency can be improved over the entire area from the high flow rate operation point to the low flow rate operation point.

According to a ninth aspect of the invention, there is provided a centrifugal compressor including an impeller, a diffuser, and the compressor scroll according to any one aspect of the first to seventh aspects.

By configuring in this manner, the performance of the centrifugal compressor can be improved.

Advantageous Effects of Invention

In the compressor scroll, efficiency can be improved at a high flow rate operation point.

DESCRIPTION OF EMBODIMENTS

First Embodiment

Next, a compressor scroll and a centrifugal compressor according to a first embodiment of the invention will be described based on the drawings. The centrifugal compressor of the embodiment is used as, for example, a compressor of a turbocharger mounted on a vehicle such as an automobile.

Figure 1:
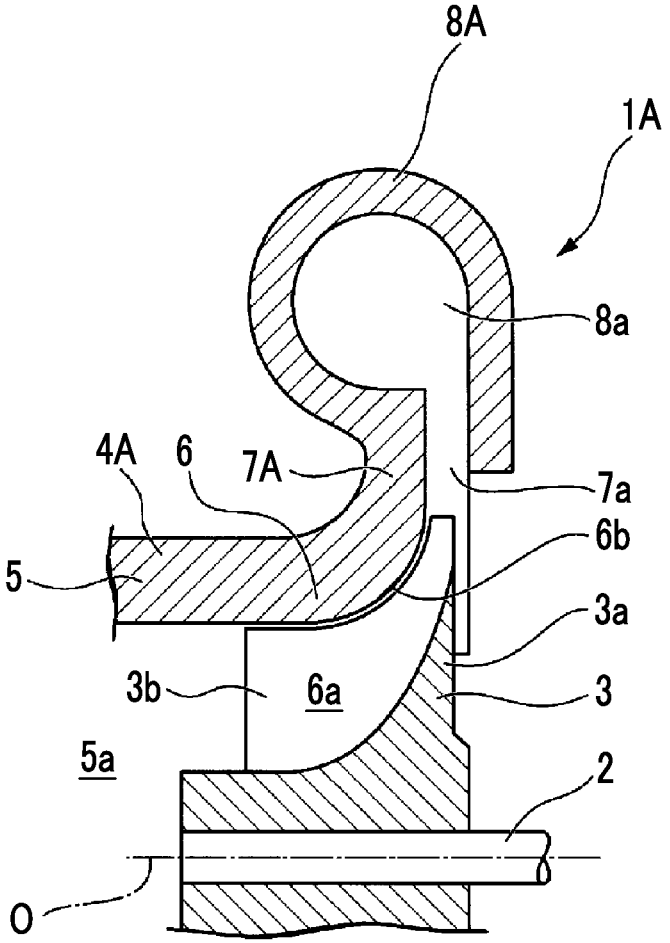
FIG. 1 is a cross sectional view of a centrifugal compressor of a first embodiment of the invention.

FIG. 1 is a cross sectional view of the centrifugal compressor of the first embodiment of the invention.

A centrifugal compressor 1A of the embodiment compresses air introduced from the outside to supply to an internal combustion engine (not illustrated). As illustrated in FIG. 1, the centrifugal compressor 1A mainly includes a rotating shaft 2, an impeller 3, and a compressor housing 4A.

The rotating shaft 2 is formed to have a columnar shape extending in an axis O direction with an axis O as a center thereof. The rotating shaft 2 is rotatably supported, for example, via a thrust bearing and a journal bearing which are accommodated in a bearing casing (not illustrated).

The impeller 3 is provided on an end portion of the rotating shaft 2. The impeller 3 includes a disk 3*a* and blades 3*b*.

The disk 3*a* is formed to have a disk-shape about the axis O. More specifically, the disk 3*a* is formed such that a diameter thereof gradually increases in a radial direction about the axis O as becoming closer to the other side (first side; the right in FIG. 1) from one side (second side; the left in FIG. 1) of the rotating shaft 2 in the axis O direction.

The plurality of blades 3*b* are formed to face a surface of the disk 3*a* on one side of the axis O direction and are formed to be at intervals in a circumferential direction of the axis O. The blades 3*b* extend to be separated apart from the disk 3*a* and are radially disposed around the axis O.

Figure 2:
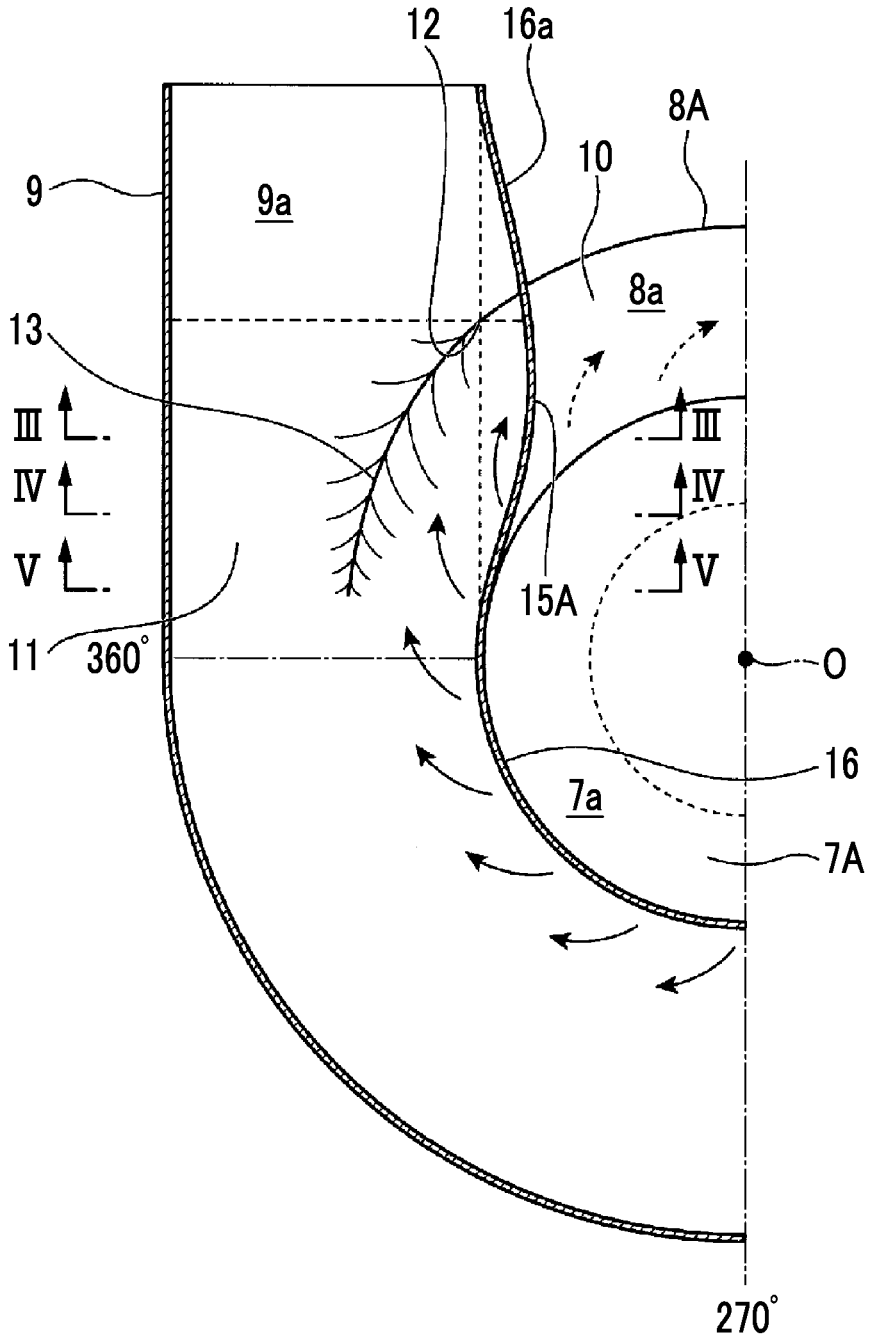
FIG. 2 is a cross sectional view of a scroll flow path forming portion and an outlet flow path forming portion according to the first embodiment of the invention.

The compressor housing 4A includes a suction flow path forming portion 5, an impeller chamber forming portion 6, a diffuser 7A, a scroll flow path forming portion 8A, and an outlet flow path forming portion 9 (refer to FIG. 2).

The suction flow path forming portion 5 forms a suction flow path 5*a* that leads a fluid introduced from the outside of the compressor housing 4A into a space 6*a* of the impeller chamber forming portion 6. The suction flow path forming portion 5 is formed to have a cylindrical shape which is open to one side of the axis O direction.

The impeller chamber forming portion 6 forms the space 6*a* accommodating the impeller 3 described above. The impeller chamber forming portion 6 has an inner circumferential surface 6*b* opposing the blades 3*b* via a small gap. The inner circumferential surface 6*b* is formed such that a diameter thereof gradually increases in the radial direction about the axis O as becoming closer to the other side from one side of the rotating shaft 2 in the axis O direction.

The diffuser 7A forms a diffuser flow path 7*a* extending in a radially outward direction from a radially outward direction end portion of the space 6*a* about the axis O. The diffuser flow path 7*a* is formed such that a flow path cross sectional area thereof gradually increases in the radially outward direction. Accordingly, the diffuser flow path 7*a* causes the pressure of a fluid fed in the radially outward direction from the impeller chamber forming portion 6 to increase. The diffuser flow path 7*a* communicates with a scroll flow path 8*a* over the entire circumference in the circumferential direction about the axis O.

FIG. 2 is a cross sectional view of the scroll flow path forming portion and the outlet flow path forming portion according to the first embodiment of the invention.

As illustrated in FIG. 2, the scroll flow path forming portion 8A forms the scroll flow path 8*a* that causes a fluid discharged from the diffuser flow path 7*a* in the radially outward direction about the axis O to rotate so as to smoothly lead the fluid to an outlet flow path 9*a*. The scroll flow path 8*a* is formed to extend in the circumferential direction about the axis O. One end of the scroll flow path has a spiral starting portion 10 in the circumferential direction, and the other end has a spiral ending portion 11. The spiral starting portion 10 refers to a predetermined area from the one end of the scroll flow path 8*a* in the circumferential direction, and the spiral ending portion 11 refers to an area that overlaps the spiral starting portion 10 on the other end of the scroll flow path 8*a* in the circumferential direction.

From the spiral starting portion 10 toward the spiral ending portion 11, the scroll flow path 8*a* is formed such that a flow path cross sectional area thereof gradually increases in a flow direction of a fluid. In addition, the spiral starting portion 10 and the spiral ending portion 11 intersect each other and communicate with each other in the scroll flow path 8*a*. In the following description, a portion where the spiral starting portion 10 intersects the spiral ending portion 11 is referred to as a tongue 12.

The outlet flow path forming portion 9 forms the outlet flow path 9*a* communicating with the spiral ending portion 11 of the scroll flow path 8*a*. The outlet flow path 9*a* extends from the spiral ending portion 11 in a tangential direction of a circle about the axis O. The outlet flow path 9*a* is formed to have a cylindrical shape which extends linearly. Herein, the outlet flow path forming portion 9 refers to a portion disposed on an outlet side of a dashed line illustrated in FIG. 2.

Figure 3:
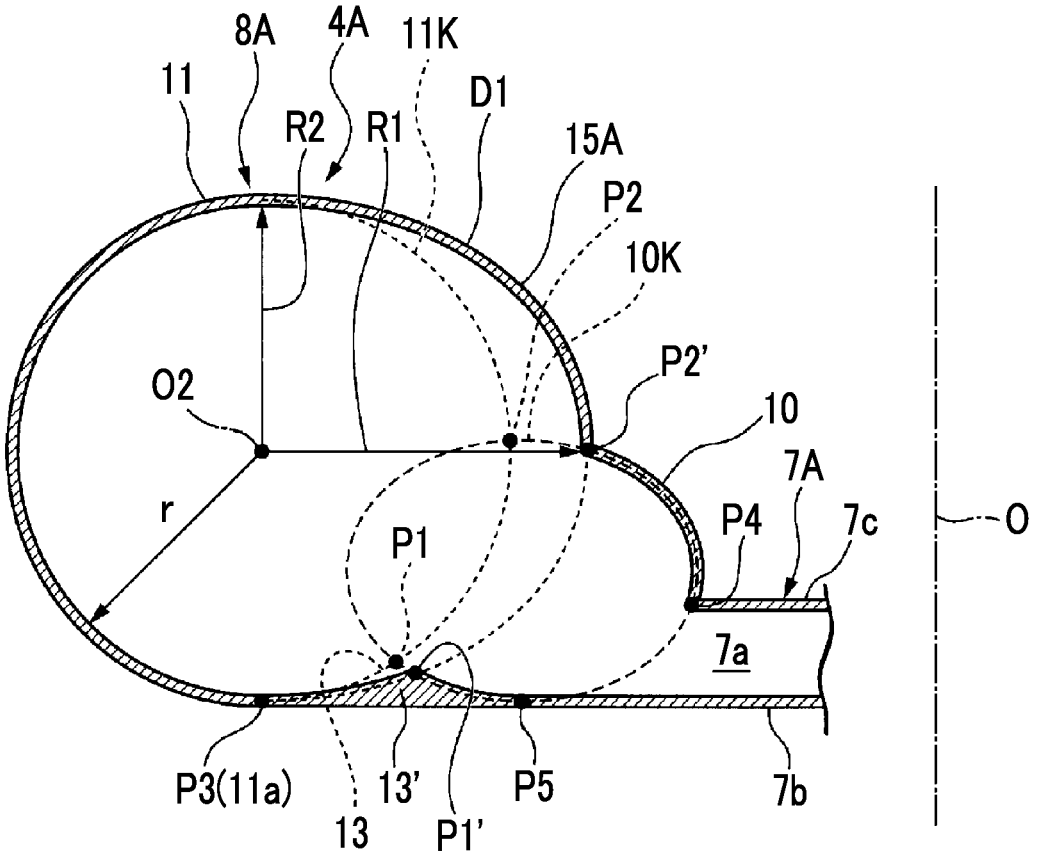
FIG. 3 is a cross sectional view taken along line III-III of FIG. 2.
Figure 4:
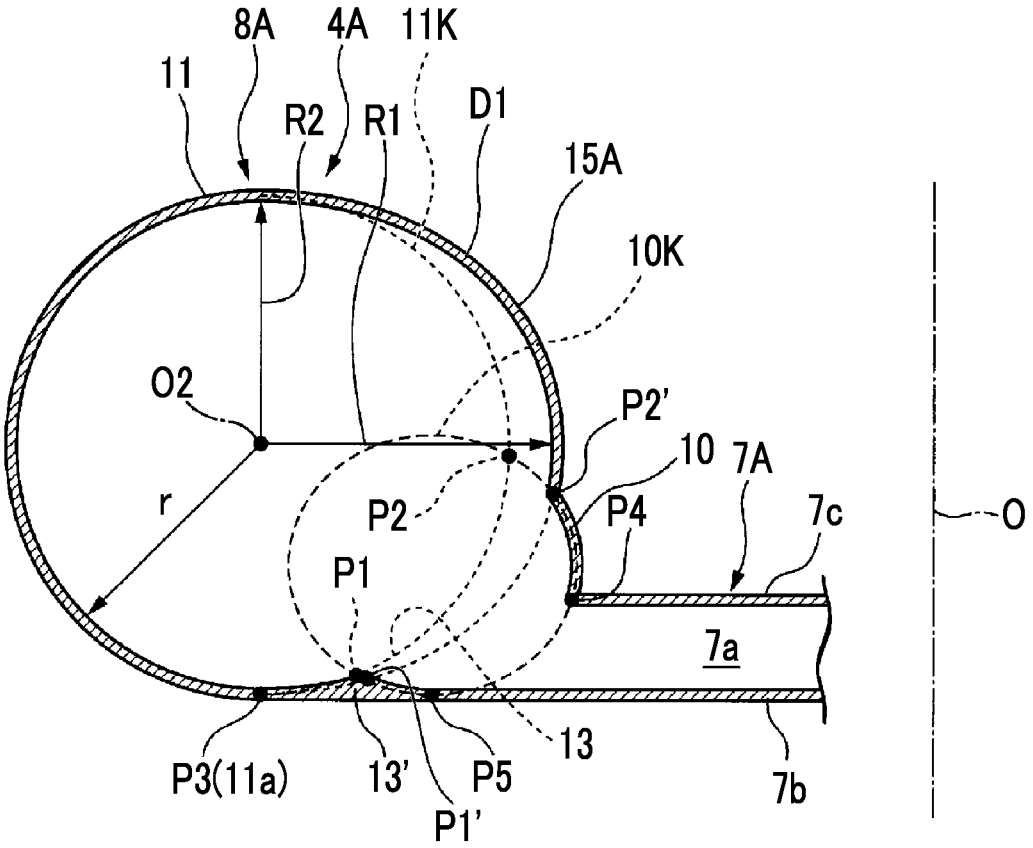
FIG. 4 is a cross sectional view taken along line IV-IV of FIG. 2.
Figure 5:
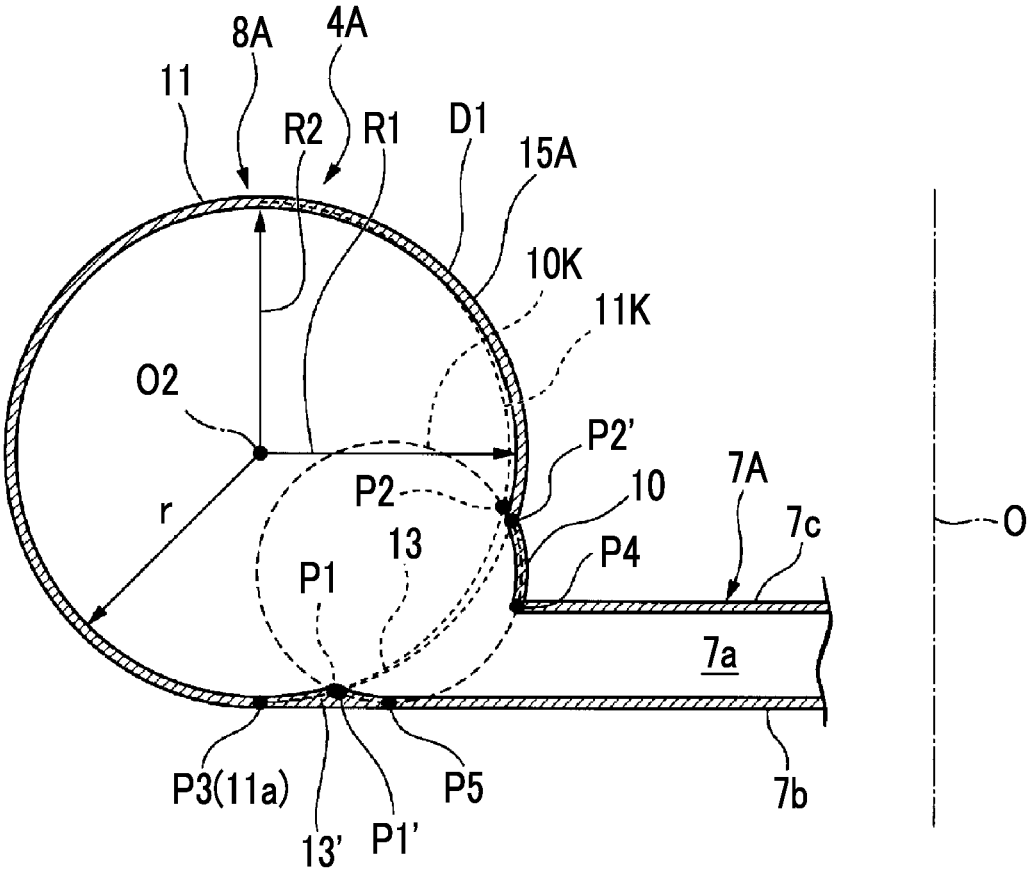
FIG. 5 is a cross sectional view taken along line V-V of FIG. 2.

FIG. 3 is a cross sectional view taken along line III-III of FIG. 2. FIG. 4 is a cross sectional view taken along line IV-IV of FIG. 2. FIG. 5 is a cross sectional view taken along line V-V of FIG. 2.

As illustrated in FIGS. 3 to 5, in a cross section orthogonal to the flow direction of the spiral ending portion 11, the spiral starting portion 10 is formed to be gradually absorbed in the radial direction about the axis O by the spiral ending portion 11 from the tongue 12 toward an upstream side of the spiral ending portion 11. In the cross section illustrated in FIG. 3, in the portion where the spiral starting portion 10 and the spiral ending portion 11 intersect each other, the spiral ending portion 11, the spiral starting portion 10, and the diffuser 7A are arranged in this order in the radial direction about the axis O.

As illustrated in FIG. 3, flow path cross sectional shapes of the spiral starting portion 10 and the spiral ending portion 11 are formed by closed curves close to a circle. For convenience of description, for example, if it is assumed that the shapes of the spiral starting portion 10 and the spiral ending portion 11 are circular, a first imaginary circle 10K forming the spiral starting portion 10 and a second imaginary circle 11K forming the spiral ending portion 11 intersect each other at two intersection points including a first intersection point P1 and a second intersection point P2. The first imaginary circle 10K and a plane extended from a wall surface 7*b* on the other side (lower side of FIG. 3) of the diffuser 7A intersect each other at a third intersection point P3. Herein, the cross section of the spiral starting portion 10 is an oval extending in the axis O direction in FIGS. 3 to 5. This is because the drawings illustrated in FIGS. 3 to 5 are cross sections obtained by obliquely cutting the spiral starting portion 10.

An edge of the spiral starting portion 10, which is the closest to the other side (lower side of FIG. 3) of the axis O direction, and a wall surface 7*c* on one side (upper side of FIG. 3) of the diffuser 7A overlap each other at a fourth intersection point P4. The spiral starting portion 10 is formed on the first imaginary circle 10K so as to cross between the first intersection point P1 and the third intersection point P3 described above, and between the second intersection point P2 and the fourth intersection point P4.

As illustrated in FIGS. 4 and 5, the spiral starting portion 10 approaches a center of the spiral ending portion 11 in the radial direction about the axis O as becoming closer to an upstream side of the scroll flow path 8*a*. For this reason, the length of a curved surface between the first intersection point P1 and the third intersection point P3 described above gradually decreases.

As illustrated in FIGS. 3 to 5, the wall surface 7*b* on the other side of the diffuser 7A in the axis O direction extends in the tangential direction with respect to an end portion 11*a* of the spiral ending portion 11, which is the closest to the other side. A ridgeline 13, which includes two recessed curved surfaces and has the first intersection point P1 as a vertex thereof, is formed between a fifth intersection point P5 where the first imaginary circle 10K and the wall surface 7*b* on the other side of the diffuser 7A intersect each other and the end portion 11*a*.

Toward the upstream side of the scroll flow path 8*a* in the spiral ending portion 11, in other words, as the spiral ending portion 11 and the spiral starting portion 10 overlap each other more, the length of the ridgeline 13 in the axis O direction decreases gradually. The height of the ridgeline 13 is practically zero at a position where the second imaginary circle 11K described above has completely entered the first imaginary circle 10K (position further on an upstream side than in FIG. 5) in a flow direction of the scroll flow path 8*a*. The vertex of the ridgeline 13 is formed as a curved ridgeline extending from the tongue 12 toward the upstream side of the scroll flow path 8*a*, as illustrated in FIG. 2.

The scroll flow path forming portion 8A described above includes an expanded portion 15A. The expanded portion 15A is formed at least in the portion where the spiral starting portion 10 and the spiral ending portion 11 intersect each other in the circumferential direction about the axis O. The expanded portion 15A is formed on a spiral ending portion 11 side of the scroll flow path 8*a*. The expanded portion 15A is formed so as to cause the scroll flow path 8*a* in the spiral ending portion 11 to expand to a spiral starting portion 10 side in the radial direction about the axis O, in other words, a side close to the axis O.

A flow path cross section of the spiral ending portion 11 according to the first embodiment is configured such that the half of the second imaginary circle 11K described above, which is on the side close to the axis O than a center O2 is, is formed by an elliptical curved line D1 disposed on an outside of a curved line of the second imaginary circle 11K. In other words, the flow path cross section of the spiral ending portion 11 is configured by the closed curve which is a combination of a circle and an ellipse. A semi-major axis R1 of the ellipse of the curved line D1 according to the first embodiment extends in a plane spreading in the radial direction about the axis O, and a semi-minor axis R2 of the ellipse extends in the axis O direction. The short radius of the ellipse is the same as a radius r of the second imaginary circle 11K. Herein, the word "expand" described above means being formed to swell further than the second imaginary circle 11K does in a radially inward direction about the axis O.

By configuring the expanded portion 15A in this manner, the position of a first intersection point P1' between the elliptical curved line D1 forming the expanded portion 15A and the first imaginary circle 10K of the spiral starting portion 10 is on the other side (lower side in FIG. 3) of the first intersection point P1 between the first imaginary circle 10K and the second imaginary circle 11K, which is described above, in the axis O direction. In other words, the height of a ridgeline 13' of which the vertex is the first intersection point P1' between the elliptical curved line D1 and the second imaginary circle 11K is smaller than the height of the ridgeline 13 of which the vertex is the first intersection point P1 between the first imaginary circle 10K and the second imaginary circle 11K over an entire area in a direction where the ridgelines 13 and 13' extend.

The scroll flow path forming portion 8A further includes an expansion changing portion 16 gradually expanding from angle positions of 270 degrees to 360 degrees with an end portion of the spiral starting portion 10 in the circumferential direction about the axis O as a starting point and having a gradually decreasing expansion amount from the tongue 12 (or the ridgeline 13') to the outlet flow path 9*a*.

Herein, according to the first embodiment described above, a case where only the inner circumferential half of the spiral ending portion 11 which is close to the axis O is formed to have an elliptical shape due to the expanded portion 15A is described. However, the entire scroll flow path 8*a* in the spiral ending portion 11 may be formed to have an elliptical shape.

Therefore, according to the first embodiment described above, the practical curvature radius of a portion of the spiral ending portion 11 intersecting the spiral starting portion 10 can be made large by forming the expanded portion 15A. For this reason, the height of the ridgeline 13' (protrusion) can be suppressed to be small, and thus peeling caused by a fluid (indicated with arrows in FIG. 2) that flows from the diffuser flow path 7*a* in the radially outward direction, about the axis O, coming into contact with the ridgeline 13' can be suppressed. As a result, it is possible to reduce a loss at a high flow rate operation point to improve efficiency.

Without increasing the dimension of the scroll flow path 8*a* in the axis O direction, the scroll flow path 8*a* can be expanded by the expanded portion 15A including the curved line D1 of which the cross section has an elliptical shape.

In a case where a cross sectional shape of the scroll flow path 8A on the upstream side of the spiral ending portion 11, which is orthogonal to the flow direction, is circular, the scroll flow path can be smoothly expanded due to the expanded portion 15A.

It is possible to suppress that a fluid flowing in the scroll flow path 8*a* toward at least one of the expanded portion 15A or an upstream side and a downstream side of the expanded portion 15A peels an inner circumferential surface of the scroll flow path forming portion 8A, by having the expansion changing portion 16.

Second Embodiment

Next, a second embodiment of the invention will be described based on the drawings. The second embodiment is different from the first embodiment described above only in terms of the shape of an expanded portion. For this reason, the same portions as those of the first embodiment will be described with the same reference signs assigned, and overlapping description will be omitted.

Figure 6:
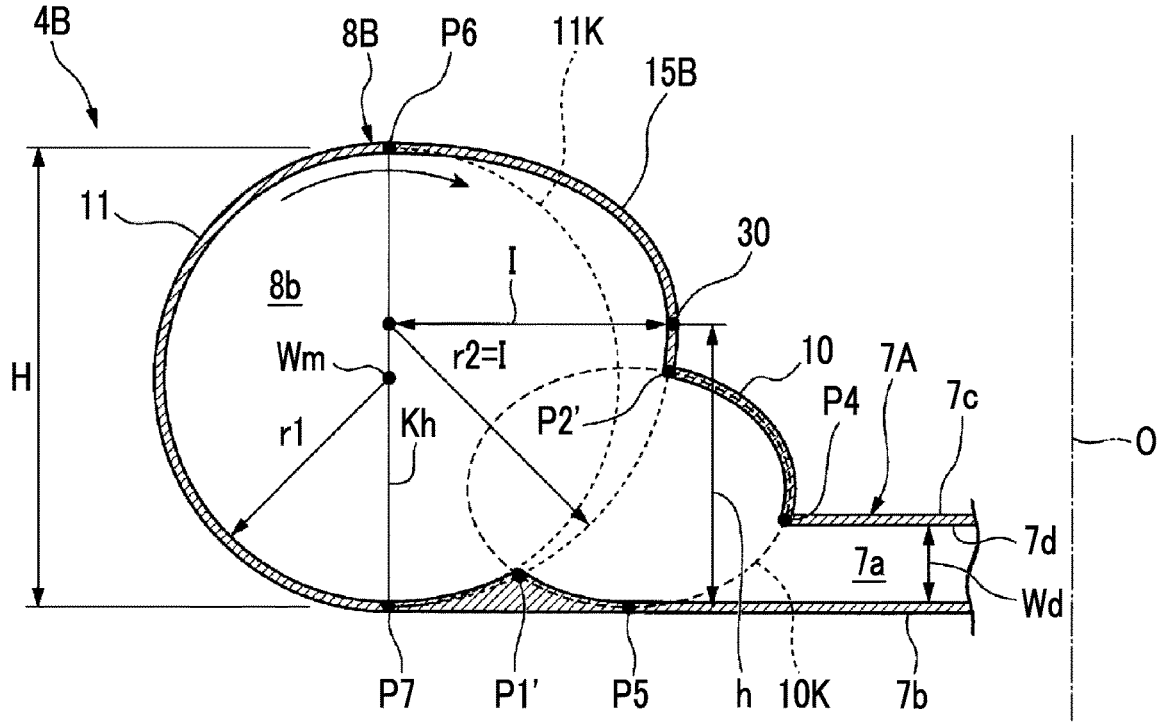
FIG. 6 is a cross sectional view corresponding to FIG. 3, in a second embodiment of the invention.

FIG. 6 is a cross sectional view corresponding to FIG. 3, in the second embodiment of the invention.

A compressor housing 4B of the second embodiment mainly includes the suction flow path forming portion 5, the impeller chamber forming portion 6, the diffuser 7A, a scroll flow path forming portion 8B, and the outlet flow path forming portion 9.

As illustrated in FIG. 6, the scroll flow path forming portion 8B forms a scroll flow path 8*b*. The scroll flow path 8*b* is formed to extend in the circumferential direction about the axis O. One end and the other end of the scroll flow path in the circumferential direction have the spiral starting portion 10 and the spiral ending portion 11, respectively. The spiral starting portion 10 and the spiral ending portion 11 intersect each other as in the first embodiment.

The scroll flow path forming portion 8B includes an expanded portion 15B. As in the expanded portion 15A of the first embodiment, the expanded portion 15B is formed at least in the portion where the spiral starting portion 10 and the spiral ending portion 11 intersect each other in the circumferential direction about the axis O. The expanded portion 15B is formed on the spiral ending portion 11 side of the scroll flow path 8*b*. The expanded portion 15B causes the scroll flow path 8*b* in the spiral ending portion 11 to expand to the spiral starting portion 10 side (in other words, an inner circumferential side) in the radial direction about the axis O.

In the expanded portion 15B of the second embodiment, a vertex 30, which is most expanded toward the side close to the axis O, is disposed to one side of the axis O direction from a middle position Wm of a maximum width dimension of the spiral ending portion 11 in the axis O direction.

A length of the spiral ending portion 11 between a point P6, which is the closest to one side, and a point P7, which is the closest to the other side, in the axis O direction is set as "H". Then, a distance h of the vertex 30 to the point P7 in the axis O direction is larger than 0.5H (h>0.5H). A shortest distance I from an imaginary plane Kh passing through the point P6 and the point P7 to the vertex 30 is larger than 0.5H (I>0.5H).

In the expanded portion 15B illustrated in FIG. 6, the distance h and the shortest distance I are the same, and a cross sectional shape of a curved surface connected to the point P7 from the vertex 30 is formed to have an arc shape of which a radius r2 is set to the distance h and the shortest distance I. A cross sectional shape of a curved surface connected to the point P6 from the vertex 30 is formed to have an elliptical arc shape of which a semi-major axis is the shortest distance I and a semi-minor axis is a difference between the length H and the distance h.

In an example of the embodiment, a dimension Wd of the diffuser 7A in the axis O direction is formed to be smaller than 0.5H.

Herein, a diffuser outlet 7*d*, which is an outlet of the diffuser flow path 7*a*, is formed in the middle of the curved surface connected to the point P7 from the vertex 30 described above.

In the second embodiment, a case where one arc is formed from the vertex 30 to the point P7 is described. However, a curved line of a cross section from the vertex 30 to the point P7 may be formed in combination with a plurality of arcs having different radiuses from each other.

Herein, the flow rate of a fluid discharged from the diffuser 7A increases at a high flow rate operation point. For this reason, when the flow rate of this fluid is set as a reference, it has the same effect as a relative decrease in a flow path cross sectional area of the scroll flow path 8B. In particular, a rotation component (indicated with an arrow close to the point P6 in FIG. 6) of a fluid in the spiral ending portion 11 increases in some cases. Due to the increase in the rotation component, a diffuser outlet flow in the tongue 12 and a rotating flow heading for the diffuser outlet 7*d* from the spiral ending portion 11 interfere each other, and peeling occurs. Thus, there is a possibility that a loss increases.

However, by disposing the vertex 30 on one side of the middle position (0.5H) of the spiral ending portion 11 as in the second embodiment described above, the curvature radius of the other side can be made larger than that of one side with the position of the vertex 30 as a boundary. For this reason, due to the increase in the curvature radius, a rotating flow of a fluid flowing along an inner circumferential surface of the elliptical arc shape collides with an inner circumferential surface of the arc shape almost perpendicularly. Accordingly, a rotation component decelerates. As a result, it is possible to suppress peeling caused by collision (interference) between the rotation component and the diffuser outlet flow.

Since the practical curvature radius of an inner circumferential surface between the vertex 30 and the point P5 can be made larger than that of the second imaginary circle 11K, an increase in the height of the ridgeline 13' can be suppressed as in the first embodiment.

(Modification Example of Second Embodiment)

Figure 7:
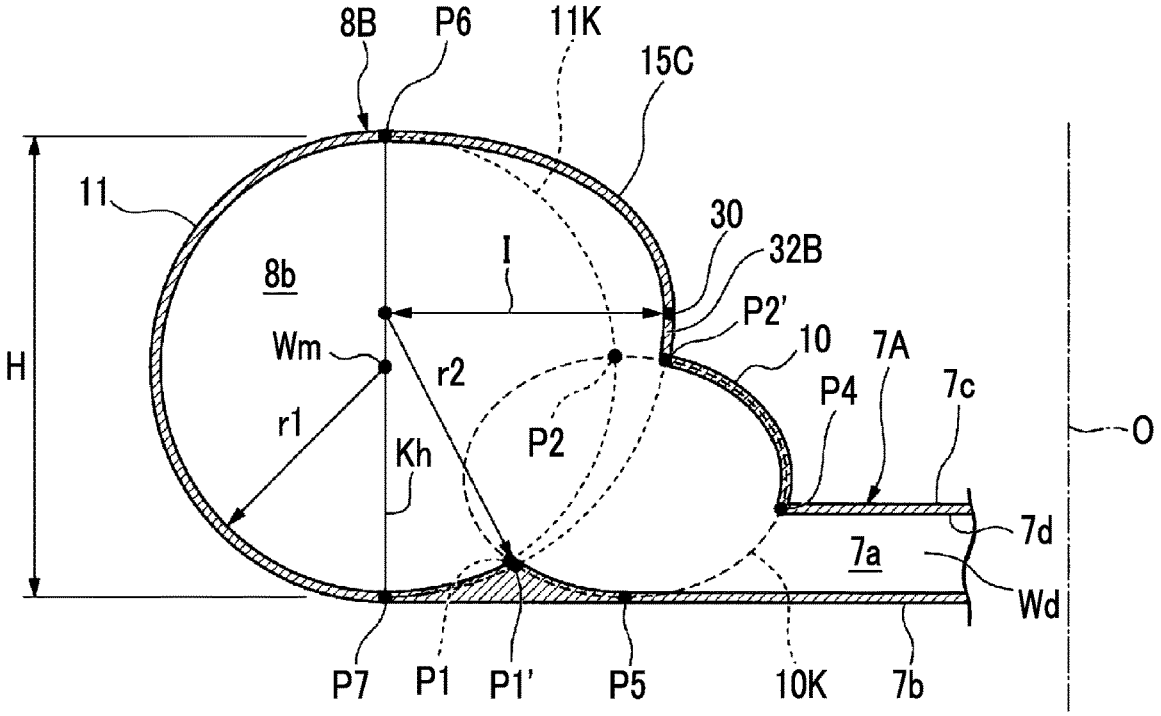
FIG. 7 is a cross sectional view corresponding to FIG. 3, in a modification example of the second embodiment of the invention.

FIG. 7 is a cross sectional view corresponding to FIG. 3, in a modification example of the second embodiment of the invention.

A case where the inner circumferential surface formed in the arc shape to connect the vertex 30 to the point P7 is described in the second embodiment described above. However, the shape is not limited thereto.

As an expanded portion 15C illustrated in FIG. 7, for example, a linear portion 32B of which a cross sectional shape is linear between the vertex 30 and the point P7 may be provided.

By configuring in this manner, it is possible to cause a rotating flow of a fluid flowing along an inner circumferential surface of an elliptical arc shape to collide with the linear portion 32B, thereby decelerating the rotating flow, as in the second embodiment described above. Since the linear portion 32B is formed to have a linear shape, it is possible to further inhibit and decelerate the rotating flow than in the case of the arc shape of the second embodiment.

Although a case where the linear portion 32B is provided between the vertex 30 and the point P7 is described in the modification example of the second embodiment, the position of the linear portion 32B is not limited to this position. For example, the linear portion 32B may be provided between the vertex 30 and the point P6. In addition, the linear portion 32B may be provided in a part between the vertex 30 and the point P7.

Third Embodiment

Next, a third embodiment of the invention will be described based on the drawings. The third embodiment is different only in that the position of the linear portion according to the modification example of the second embodiment described above is changed to be on the upstream side of the spiral ending portion 11. For this reason, the same portions as those of the first embodiment and the modification example of the second embodiment will be described with the same reference signs assigned, and overlapping description will be omitted.

Figure 8:
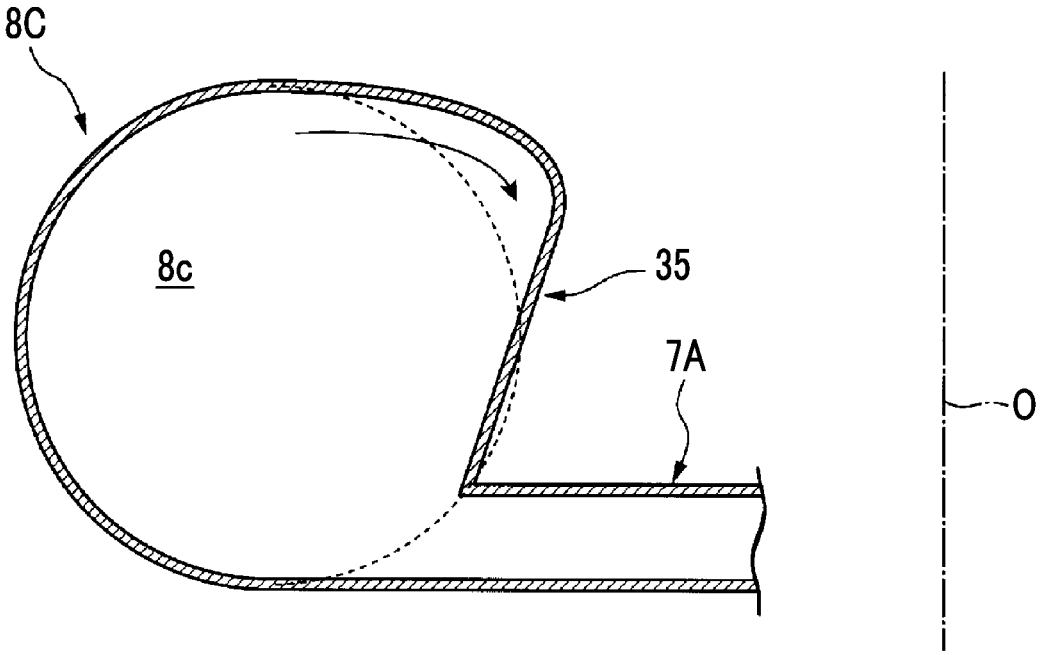
FIG. 8 is a cross sectional view of a scroll flow path forming portion at a position of 360 degrees according to a third embodiment of the invention.
Figure 9:
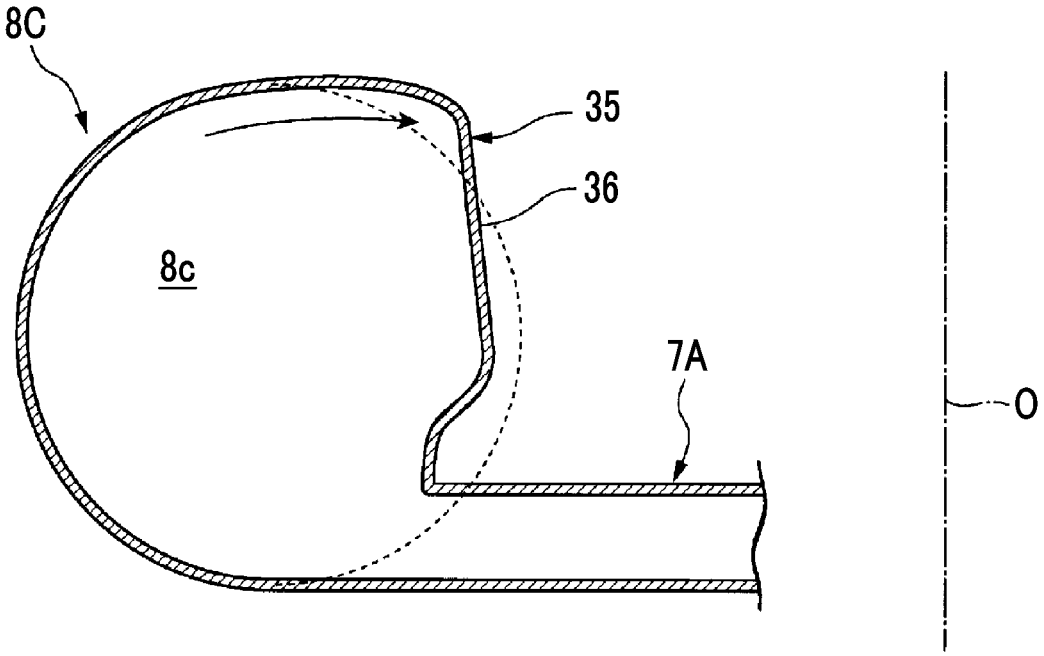
FIG. 9 is a cross sectional view of the scroll flow path forming portion at a position of 315 degrees according to the third embodiment of the invention.
Figure 10:
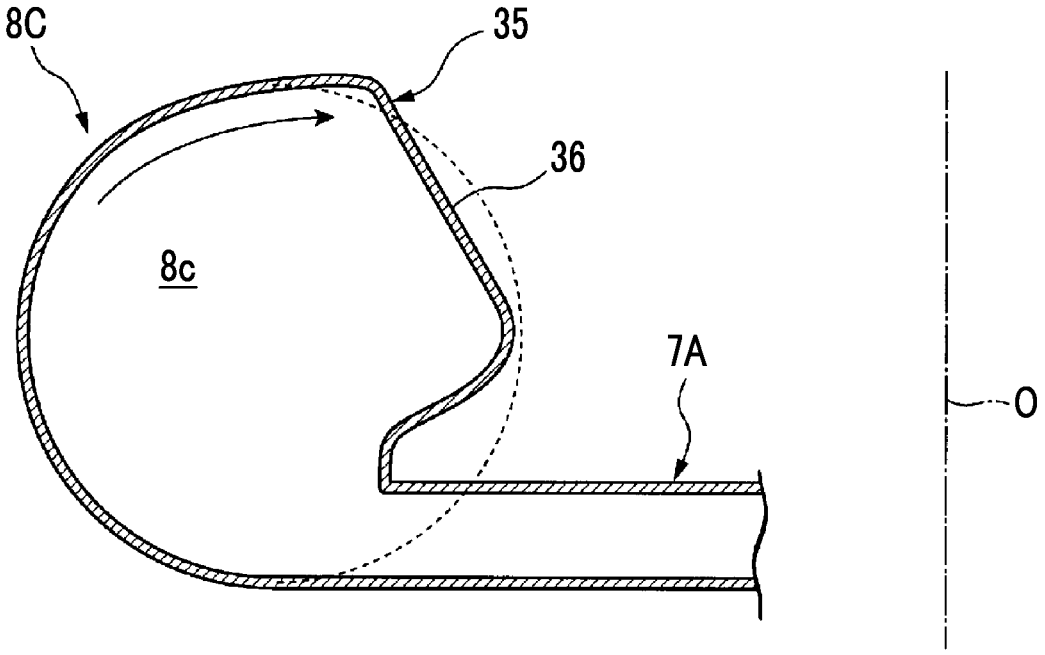
FIG. 10 is a cross sectional view of the scroll flow path forming portion at a position of 270 degrees according to the third embodiment of the invention.

FIG. 8 is a cross sectional view of a scroll flow path forming portion at a position of 360 degrees according to the third embodiment of the invention. FIG. 9 is a cross sectional view of the scroll flow path forming portion at a position of 315 degrees according to the third embodiment of the invention. FIG. 10 is a cross sectional view of the scroll flow path forming portion at a position of 270 degrees according to the third embodiment of the invention.

As illustrated in FIGS. 8 to 10, a scroll flow path forming portion 8C of the third embodiment has a linearly changing portion 35. The linearly changing portion 35 is formed on the upstream side of the spiral ending portion 11. More specifically, the linearly changing portion 35 of the embodiment is formed within a range of 270 degrees to 360 degrees (refer to FIG. 2) in a circumferential direction of a scroll flow path 8*c* about the axis O.

The linearly changing portion 35 has a linear portion 36 which forms a linear part of a flow path cross section of the scroll flow path 8*c*. The linearly changing portion 35 may be formed such that the linear portion 36 gradually moves in an inner circumferential side of the scroll flow path forming portion 8C about the axis O from one side to the other side in the axis O direction as the scroll flow path 8*c* becoming closer to a downstream side (360 degrees) from an upstream side (270 degrees). The linear portion 36 is formed so as to be continuous to the linear portion 32B formed in the expanded portion 15C of the second embodiment, which is formed in the spiral ending portion 11. Herein, a direction, in which the linear portion 32B extends in a flow path cross section, is provided to be orthogonal to a rotating flow (indicated with an arrow in FIGS. 8 to 10). The expansion changing portion 16 described above as well is formed at a location where the linearly changing portion 35 is formed, but is omitted in FIGS. 8 to 10 for convenience of illustration.

Therefore, according to the third embodiment, in the scroll flow path 8*c* on the upstream side of the spiral ending portion 11, the rotating speed of a rotating flow can be gradually decreased, and a rotation component can be sufficiently decreased at the position of the spiral ending portion 11.

Fourth Embodiment

Next, a fourth embodiment of the invention will be described based on the drawings. The fourth embodiment is different from each of the embodiments described above only in terms of a cross sectional shape of a spiral starting portion of a scroll flow path. For this reason, the same portions as those of the first to third embodiments will be described with the same reference signs assigned, and overlapping description will be omitted.

Figure 11:
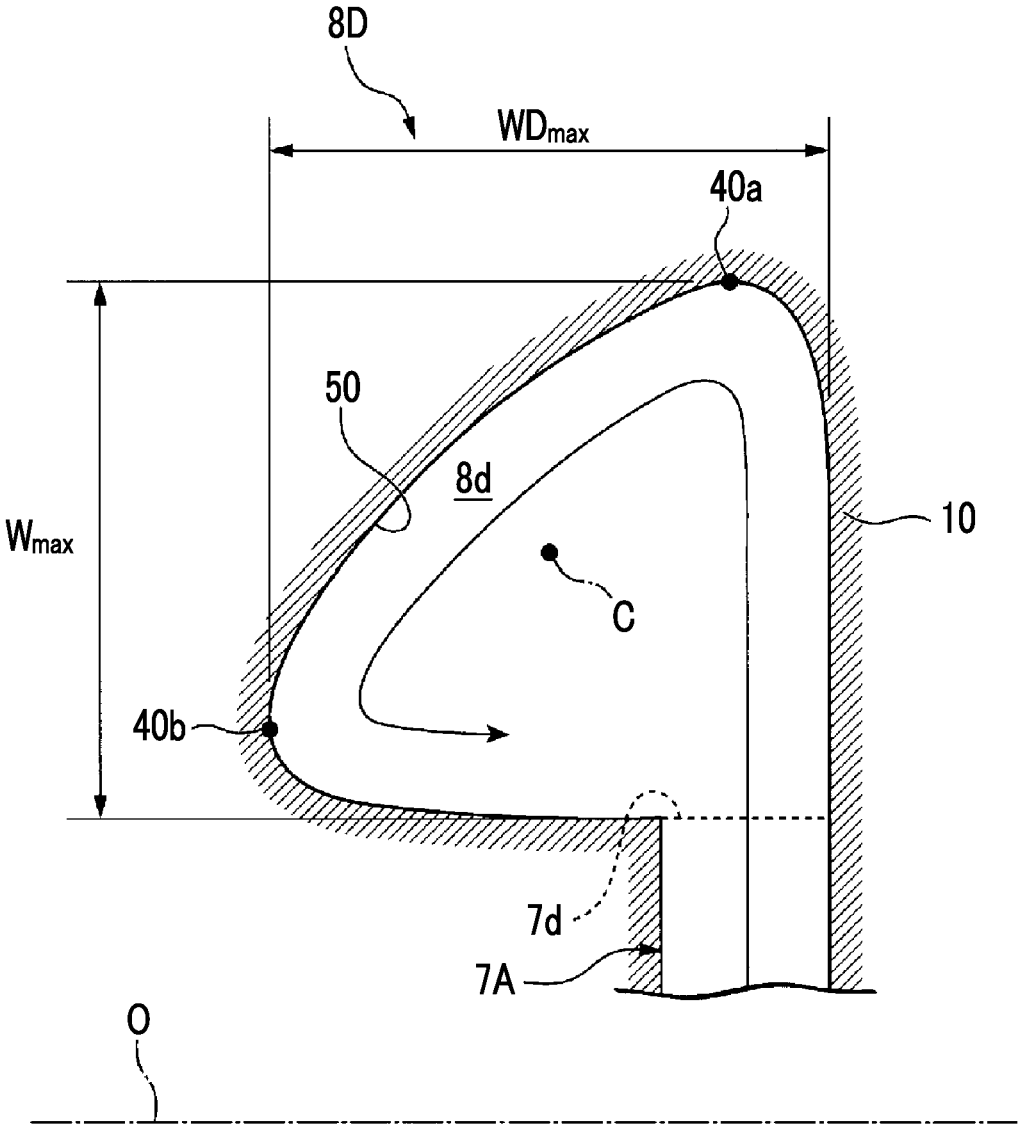
FIG. 11 is a cross sectional view of a spiral starting portion according to a fourth embodiment of the invention.

FIG. 11 is a cross sectional view of a spiral starting portion according to the fourth embodiment of the invention.

A scroll flow path forming portion 8D of the fourth embodiment has, in the spiral starting portion 10 of a scroll flow path 8*d*, a recirculation flow suppression cross section 50 which is formed such that a flow path width WD in the axis O direction gradually increases from a first vertex 40*a* disposed on the outermost side in the radial direction about the axis O toward a second vertex 40*b* disposed to be closest to one side of the axis O direction. The second vertex 40*b* disposed radially inside a middle position of a maximum flow path width Wmax in the radial direction about the axis O.

Herein, as illustrated in FIG. 11, the first vertex 40*a* of the spiral starting portion 10 according to the embodiment is disposed on the other side (the right in FIG. 11) of a midpoint C, which is common to the maximum flow path width WDmax in the axis O direction and the maximum flow path width Wmax in the radial direction about the axis O, in the axis O direction.

The second vertex 40*b* disposed on an inside of the midpoint C in the radial direction about the axis O. That is, in the spiral starting portion 10, a flow path cross sectional shape of the scroll flow path forming portion 8D of the embodiment is similar to a triangular shape. It is sufficient that the flow path cross sectional shape of the spiral starting portion 10 has a recirculation flow suppression cross section 50, and the flow path cross sectional shape is not limited to the shape similar to a triangular shape.

The flow path cross sectional shape of the spiral starting portion 10 may gradually return to a circular shape toward a downstream side of the scroll flow path 8*d*.

Therefore, according to the fourth embodiment described above, an inner circumferential surface of the scroll flow path 8*d* from the first vertex 40*a* to the second vertex 40*b* can be made nearly flat by the recirculation flow suppression cross section 50 being provided. For this reason, at a low flow rate operation point, a diffuser outlet flow in the spiral starting portion 10 quickly turns at the first vertex 40*a* to reach the second vertex 40*b*, and can return to the diffuser outlet 7*d* from the second vertex 40*b*. That is, the diffuser outlet flow can quickly return to an inner circumferential side of the scroll flow path 8*d* about the axis O. Accordingly, it is possible to better suppress the recirculation of a fluid from the spiral ending portion 11 to an inner circumferential side of the spiral starting portion 10 at a low flow rate operation point than in a case where the flow path cross sectional shape of the spiral starting portion 10 is circular.

In addition, it is possible to suppress a loss occurred due to peeling by a fluid by adopting the configurations of the first to third embodiments described above for the spiral ending portion 11. As a result, efficiency can be improved at both of a low flow rate operation point and a high flow rate operation point.

The invention is not limited to each of the embodiments and each modification example described above, and various modifications may be added to each of the embodiments and each modification example described above without departing from the spirit of the invention. That is, a specific shape or a specific configuration described in each embodiment and each modification example is merely an example, and can be modified as appropriate.

For example, although a case where the open impeller 3 is included is described in each of the embodiments described above, a so-called closed impeller including a cover may be used.

A case where the flow path cross sectional shape of the scroll flow path 8*a* excluding the spiral starting portion 10 and the spiral ending portion 11 is circular is described in the first to third embodiments. However, the flow path cross sectional shape may be configured by a closed curve having other than a circular shape.

INDUSTRIAL APPLICABILITY

The invention can be applied to a compressor scroll and a centrifugal compressor. According to the invention, efficiency can be improved at a high flow rate operation point.

REFERENCE SIGNS LIST

1A: centrifugal compressor
2: rotating shaft
3: impeller
3*a*: disk
3*b*: blade
4A, 4B: compressor housing
5: suction flow path forming portion
5*a*: suction flow path
6: impeller chamber forming portion
6*a*: space
6*b*: inner circumferential surface
7A: diffuser
7*a*: diffuser flow path
7*b*: wall surface
7*c*: wall surface
7*d*: diffuser outlet
8A, 8B, 8C, 8D: scroll flow path forming portion
8*a*, 8*b*, 8*c*, 8*d*: scroll flow path
9: outlet flow path forming portion
9*a*: outlet flow path
10: spiral starting portion
10K: first imaginary circle
11: spiral ending portion
11K: second imaginary circle
12: tongue
13, 13': ridgeline
15A, 15B: expanded portion
16: expansion changing portion
D1: curved line
R1: semi-major axis
R2: semi-minor axis
28: scroll flow path forming portion

30: vertex
32B: linear portion
35: linearly changing portion
36: linear portion
40*a*: first vertex
40*b*: second vertex
50: recirculation flow suppression cross section

The invention claimed is:

1. A compressor scroll comprising:

a scroll flow path forming portion that forms a scroll flow path extending in a circumferential direction about an axis that extends toward a first side and a second side opposite to each other, having a spiral starting portion and a spiral ending portion intersecting and communicating with each other, and allowing a fluid to flow therein from a diffuser outlet formed on the first side and in a radially inward direction about the axis; and an outlet flow path forming portion that forms an outlet flow path communicating with the spiral ending portion of the scroll flow path and extending in a tangential direction of a circle about the axis, wherein, in a cross section orthogonal to a flow direction of the scroll flow path, at least a radially outside part of an inner circumferential surface of the spiral ending portion has an arc shape overlapping a part of an imaginary circle, wherein the scroll flow path forming portion includes an expanded portion, which causes the scroll flow path to expand from the imaginary circle toward the spiral starting portion in the radial direction, at least in the spiral ending portion in a portion where the spiral starting portion and the spiral ending portion intersect each other.

2. The compressor scroll according to claim 1, wherein the spiral starting portion is formed such that a flow path width in a direction where the axis extends gradually increases from a first vertex disposed on a outermost side of a radial direction about the axis toward a second vertex disposed to be closest to the second side, and the second vertex is disposed radially inside a midpoint of a maximum flow path width in the radial direction.

3. A centrifugal compressor comprising an impeller, a diffuser, and the compressor scroll according to claim 1.

4. The compressor scroll according to claim 1, further comprising:

an expansion changing portion in which expansion of the expanded portion gradually, reduces as the expanded portion approaches at least one of an upstream side or a downstream side of the scroll flow path.

5. The compressor scroll according to claim 4, wherein the expanded portion further includes a curved surface of which a cross section has an elliptical shape having a major axis extending toward a side close to the axis.

6. The compressor scroll according to claim 4, wherein the expanded portion includes a vertex that is point on the expanded portion closest to the axis when viewed on a cross section orthogonal to the scroll flow path and is disposed to the second side with respect to a middle position of a maximum width dimension of the spiral ending portion in the direction where the axis extends.

7. The compressor scroll according to claim 4, wherein the spiral starting portion is formed such that a flow path width in a direction where the axis extends gradually increases from a first vertex disposed on a outermost side of a radial direction about the axis toward a second vertex disposed to be closest to the second side, and the second vertex is disposed radially inside a midpoint of a maximum flow path width in the radial direction.

8. A centrifugal compressor comprising an impeller, a diffuser, and the compressor scroll according to claim 4.

9. The compressor scroll according to claim 1, wherein the expanded portion further includes a curved surface of which a cross section has an elliptical shape having a major axis extending toward a side close to the axis.

10. The compressor scroll according to claim 9, wherein the expanded portion includes a vertex that is point on the expanded portion closest to the axis when viewed on a cross section orthogonal to the scroll flow path and is disposed to the second side with respect to a middle position of a maximum width dimension of the spiral ending portion in the direction where the axis extends.

11. The compressor scroll according to claim 9, wherein the spiral starting portion is formed such that a flow path width in a direction where the axis extends gradually increases from a first vertex disposed on a outermost side of a radial direction about the axis toward a second vertex disposed to be closest to the second side, and the second vertex is disposed radially inside a midpoint of a maximum flow path width in the radial direction.

12. A centrifugal compressor comprising an impeller, a diffuser, and the compressor scroll according to claim 9.

13. The compressor scroll according to claim 1, wherein the expanded portion includes a vertex that is a point on the expanded portion closest to the axis when viewed on a cross section orthogonal to the scroll flow path and is disposed to the second side a middle position of a maximum width dimension of the spiral ending portion in the direction where the axis extends.

14. The compressor scroll according to claim 13, wherein the spiral starting portion is formed such that a flow path width in a direction where the axis extends gradually increases from a first vertex disposed on the outermost side of a radial direction about the axis toward a second vertex disposed to be closest to the second side, and the second vertex is disposed radially inside a midpoint of a maximum flow path width in the radial direction.

15. The compressor scroll according to claim 13, wherein the expanded portion includes a linear portion, which has a linearly formed cross sectional shape orthogonal to the scroll flow path, in at least a part of an inner circumferential surface thereof.

16. The compressor scroll according to claim 15, wherein the spiral starting portion is formed such that a flow path width in a direction where the axis extends gradually increases from a first vertex disposed on the outermost side of a radial direction about the axis toward a second vertex disposed to be closest to the second side, and the second vertex is disposed radially inside a midpoint of a maximum flow path width in the radial direction.

17. The compressor scroll according to claim 15, wherein the expanded portion has the linear portion which is formed from the vertex.

18. The compressor scroll according to claim 17, wherein the spiral starting portion is formed such that a flow path width in a direction where the axis extends gradually increases from a first vertex disposed on the outermost side of a radial direction about the axis toward a second vertex disposed to be closest to the second side, and the second vertex is disposed radially inside a midpoint of a maximum flow path width in the radial direction.

19. The compressor scroll according to claim 17, further comprising:

a linearly changing portion that is formed such that the linear portion gradually shifts from the second side to the first side as the linear portion approaches an upstream side of the scroll flow path from the expanded portion.

20. The compressor scroll according to claim 19, wherein the spiral starting portion is formed such that a flow path width in a direction where the axis extends gradually increases from a first vertex disposed on the outermost side of a radial direction about the axis toward a second vertex disposed to be closest to the second side, and the second vertex is disposed radially inside a midpoint of a maximum flow path width in the radial direction.

* * * * *